US005561877A

United States Patent [19]

Oh

[11] Patent Number: 5,561,877

[45] Date of Patent: Oct. 8, 1996

[54] DOUBLE STRUCTURE SPRING MATTRESS

[76] Inventor: Jae H. Oh, 104-1603 Hyundai, #66, Gaesan-Dong, Buk-Ku, Incheon-Jickhalshi, Rep. of Korea

[21] Appl. No.: 387,061

[22] Filed: Feb. 10, 1995

[30] Foreign Application Priority Data

Aug. 16, 1994 [KR] Rep. of Korea ..... 94-20136
Aug. 17, 1994 [KR] Rep. of Korea ..... 94-20242

[51] Int. Cl.[6] ..... A47C 27/04
[52] U.S. Cl. ..... 5/716; 5/260
[58] Field of Search ..... 5/464, 475, 476, 5/260

[56] References Cited

U.S. PATENT DOCUMENTS

| | | | |
|---|---|---|---|
| 547,604 | 10/1895 | Frank | 5/247 |
| 584,922 | 6/1897 | Cochrane | 5/247 |
| 641,361 | 1/1900 | Beall | 5/247 |
| 2,241,039 | 5/1941 | Mattison | 5/464 |
| 2,257,994 | 10/1941 | Zofnass | 5/475 |
| 2,874,389 | 2/1959 | Koenigsberg | 5/475 |
| 2,978,715 | 4/1961 | Blecker | 5/475 |
| 3,590,404 | 7/1971 | Dreve, Jr. | 5/475 |
| 4,207,634 | 6/1980 | Kitchen et al. . | |
| 4,234,981 | 11/1980 | Hanson | 5/475 |
| 4,667,357 | 5/1987 | Fortune | 5/475 |
| 4,726,572 | 2/1988 | Flesher et al. . | |
| 4,771,495 | 9/1988 | Distler et al. . | |
| 4,918,773 | 4/1990 | Scott . | |

FOREIGN PATENT DOCUMENTS

| | | | |
|---|---|---|---|
| 518688 | 11/1955 | Canada | 5/475 |
| 2143731 | 2/1985 | United Kingdom . | |
| 2198938 | 6/1988 | United Kingdom . | |

*Primary Examiner*—Michael J. Milano
*Attorney, Agent, or Firm*—Quarles & Brady

[57] ABSTRACT

A double structure spring mattress with hard spring mattress effect as well as soft spring mattress effect, one side of which mattress is backed by hard springs but the other side of which mattress is backed by soft springs coupled to the hard springs, is disclosed. The double structure spring mattress may be provided with a reinforcing spring for reinforcing the top and bottom edges of the mattress, which reinforcing spring is repeatedly coiled with regular intervals and formed into a zigzag shape having a plurality of coiled portions and fixed to top and bottom guide wires extending in the top and bottom edges of the mattress at the coiled portions using fixing rings. The spring mattress commonly meets taste of peoples preferred to use the hard spring mattress and taste of peoples preferred to use the soft spring mattress.

2 Claims, 2 Drawing Sheets

DOUBLE STRUCTURE SPRING MATTRESS

BACKGROUND OF THE INVENTION

1. Field of the Invention

The present invention relates in general to spring mattresses for beds and, more particularly, to a structural improvement in such spring mattresses for providing a hard spring mattress effect as well as a typical soft spring mattress effect for a mattress by providing a hard spring for one side of the mattress and a typical soft spring for the other side of the mattress and integrating the hard and soft springs into a double structure spring of the mattress.

2. Description of the Prior Art

Conventionally, commercialized spring mattresses for beds are soft spring mattresses using soft springs, meeting taste of healthy young peoples. However, some peoples, particularly trouble-waisted peoples, old peoples and fatty peoples, are preferred to use hard spring mattresses rather than use the soft spring mattresses, nevertheless they have inevitably endured inconvenience caused by use of the soft spring mattresses because there is no commercialized hard spring mattress. In this regard, it needs to provide hard spring mattresses for such peoples. Furthermore, it will be more profitable to provide a spring mattress having the hard spring mattress effect as well as the soft spring mattress effect because such a spring mattress will commonly meet taste of peoples preferred to use the hard spring mattress and taste of peoples preferred to use the soft spring mattress.

SUMMARY OF THE INVENTION

It is, therefore, an object of the present invention to provide a double structure spring mattress with hard spring mattress effect as well as soft spring mattress effect, one side of which mattress is backed by hard springs but the other side of which mattress is backed by typical soft springs, which hard and soft springs are integrated into double structure springs of the mattress.

It is another object of the present invention to provide a double structure spring mattress which is provided with a reinforcing spring for reinforcing the top and bottom edges of the mattress, which reinforcing spring is repeatedly coiled with regular intervals and formed into a zigzag shape having a plurality of coiled portions and fixed to top and bottom guide wires extending in the top and bottom edges of the mattress at the coiled portions using fixing rings.

In an aspect, the present invention provides a double structure spring mattress comprising: a plurality of hard springs provided for one side of the mattress in order for forming a hard side of the mattress; and a plurality of soft springs provided for the other side of the mattress in order for forming a soft side of the mattress, the soft springs being connected to the hard springs by means of fixing rings respectively, thus to form double structure springs of the mattress.

In another aspect, the present invention provides a double structure spring mattress comprising: a reinforcing spring siding a side surface of the mattress in order for reinforcing top and bottom edges of the mattress, the reinforcing spring being repeatedly coiled with regular intervals and formed into a zigzag shape having a plurality of coiled portions and fixed to top and bottom guide wires of the mattress at their coiled portions using a plurality of fixing rings, the top and bottom guide wires extending in the top and bottom edges of the mattress respectively.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
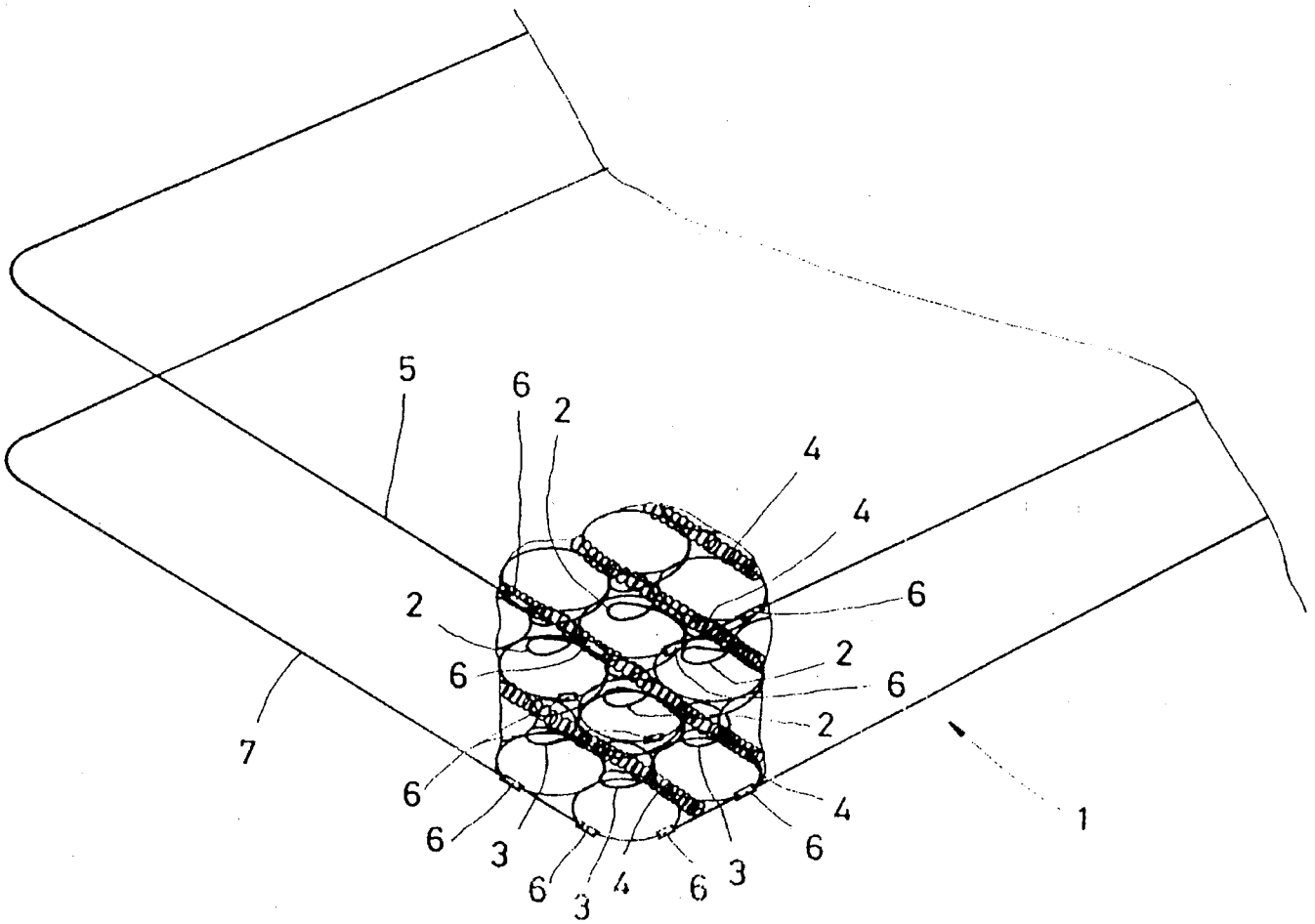
FIG. 1 is a partially broken perspective view of a double structure spring mattress in accordance with a primary embodiment of the invention, showing double structure springs provided in the interior of the mattress.

With reference to FIG. 1, there is shown in a partially broken perspective view a double structure spring mattress in accordance with a primary embodiment of the invention. As shown in the drawing, the double structure spring mattress 1 of the invention is provided with two types of springs, that is, a plurality of hard springs 2 provided for one side, for example, the top side, of the mattress 1 and a plurality of soft springs 3 provided for the other side, for example, the bottom side, of the mattress 1. The hard springs 2 thus make the one side of the mattress 1 become a hard side, while the soft springs 3 make the other side of the mattress 1 become a soft side.

Each of the springs 2 and 3 is a coil spring which is made of a steel wire coiled four or five times regardless of types of the springs 2 and 3, which steel wire for each spring 2 or 3 has a diameter of 2.0 mm–3.0 mm. The configuration of each spring 2 or 3 may be selected from a Bonnell spring, an offset spring and a Coziflex spring. Each of the springs 2 and 3 is a coil spring which is made of a steel wire. The steel wire of spring 2 has a diameter of 2.2 mm to 2.3 mm, and the steel wire of spring 3 has a diameter of 2.6 mm. Spring 2 is coiled four times while the spring 3 is coiled four or five times. The configuration of each spring 2 or 3 may be selected from a Bonnell spring, an offset spring and a Coziflex spring.

The hard springs 2 for the top side of the mattress 1 are transversely arranged in a plurality of lines in the mattress 1 and connected to each other by a plurality of connection coil springs 4 transversely extending in the mattress 1. In addition, the hard springs 2 placed about a first guide wire, for example, a top guide wire 5 of the mattress 1 are fixed to the guide wire 5 using typical fixing rings 6, thus to keep the positions of the hard springs 2 in the mattress 1.

In the same manner, the soft springs 3 for the bottom side of the mattress 1 are transversely arranged in a plurality of lines in the mattress 1 and connected to each other by a plurality of connection coil springs 4 transversely extending in the mattress 1. In addition, the soft springs 3 placed about a second guide wire, for example, a bottom guide wire 7 of the mattress 1 are fixed to the guide wire 7 using typical fixing rings 6, thus to keep the positions of the soft springs 3 in the mattress 1. The bottoms of the hard springs 2 and the tops of their associated soft springs 3 are connected to each other using fixing rings 6 so that the hard springs 2 and the soft springs 3 are integrated into the double structure springs of the mattress 1 of the invention.

Figure 2:
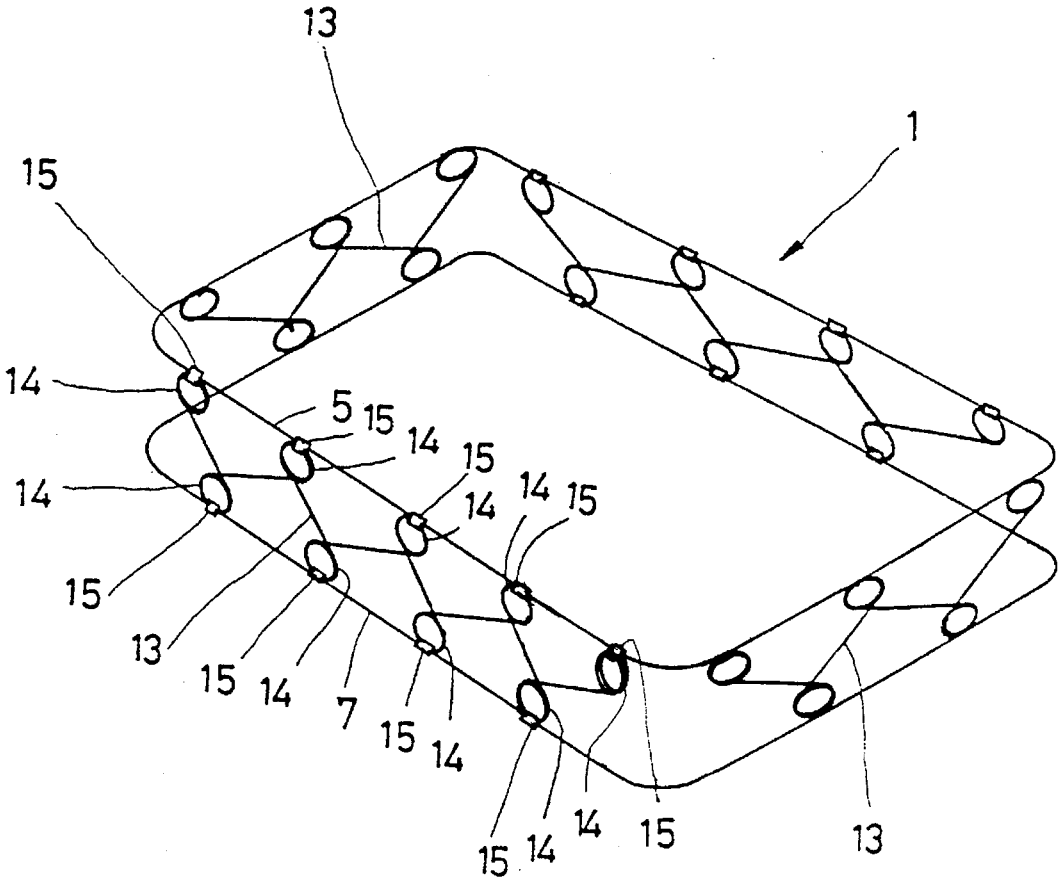
FIG. 2 is a perspective view of a double structure spring mattress added with a reinforcing spring in accordance with another embodiment of the present invention.

Turning to FIG. 2, there is shown a double structure spring mattress added with a reinforcing spring in accordance with another embodiment of the present invention. In this drawing, the double structure coil springs of the mattress 1 are not viewed. As shown in FIG. 2, the mattress 1 which is provided with the top and bottom guide wires 5 and 7 in its top and bottom edges includes the reinforcing spring 13, which spring 13 is adapted for reinforcing the top and bottom edges of the mattress 1 and repeatedly coiled with regular intervals and formed into a zigzag shape having a plurality of coiled portions 14 and fixed to the top and bottom guide wires 5 and 7 extending in the top and bottom edges of the mattress at the coiled portions 14 using a plurality of fixing rings 15.

In the present invention, the reinforcing spring 13 is made of a steel wire having a diameter of 2.8 mm–3.8 mm and a length of 1 m–10 m. The coiled portion 14 of the reinforcing spring 13 is coiled once or twice with a coiling diameter of 30–80 mm.

When using the double structure mattress 1 for a person preferred to use the hard spring mattress rather than use the soft spring mattress, the mattress 1 is placed on a bed (not shown) such that the top side or the hard side backed by the hard springs 2 is directed upward as shown in the drawings FIG. 1. On the contrary, when using the double structure mattress 1 for a person preferred to use the soft spring mattress rather than use the hard spring mattress, the mattress 1 is placed on the bed such that the bottom side or the soft side backed by the soft springs 3 is directed upward by turning over the mattress 1. Therefore, the double structure spring mattress commonly meets taste of peoples preferred to use the hard spring mattress and taste of peoples preferred to use the soft spring mattress.

In addition, the double structure spring mattress 1 of the invention doubles the expected life span of the mattress in comparison with a typical single structure spring mattress.

Furthermore, the mattress 1 of the invention is provided with the reinforcing spring 13 which is adapted for reinforcing the top and bottom edges of the mattress 1 and repeatedly coiled with regular intervals and formed into the zigzag shape having the plurality of coiled portions 14 and fixed to the top and bottom guide wires 5 and 7 extending in the top and bottom edges of the mattress 1 at the coiled portions 14 using the plurality of fixing rings 15. The reinforcing spring 13 uniformly distributes a load partially applied on an edge portion of the mattress 1 to the whole parts of the mattress 1, thus to completely prevent possible partial sagging of the top and bottom edges of the mattress 1 due to load partially acting on the edges of the mattress 1. With the coiled portions 14, the reinforcing spring 13 is readily installed in the mattress 1.

As described above, the present invention provides a double structure spring mattress, one side of which mattress is backed by hard springs but the other side of which mattress is backed by typical soft springs, which hard and soft springs are integrated into double structure springs of the mattress and thereby provide the hard spring mattress effect as well as the soft spring mattress effect for the mattress. The double structure spring mattress may be provided with a reinforcing spring for reinforcing the top and bottom edges of the mattress, which reinforcing spring is repeatedly coiled with regular intervals and formed into a zigzag shape having a plurality of coiled portions and fixed to top and bottom guide wires extending in the top and bottom edges of the mattress at the coiled portions using fixing rings. Therefore, the double structure spring mattress commonly meets taste of peoples preferred to use the hard spring mattress and taste of peoples preferred to use the soft spring mattress.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A double structure spring mattress comprising:

a reinforcing spring siding a side surface of the mattress in order for reinforcing top and bottom edges of the mattress, said reinforcing spring being repeatedly coiled with regular intervals and formed into a zigzag shape having a plurality of coiled portions and fixed to top and bottom guide wires of the mattress at their coiled portions using a plurality of fixing rings, said top and bottom guide wires extending in said top and bottom edges of the mattress respectively.

2. The double structure spring mattress according to claim 1, wherein said coiled portion of the reinforcing spring is coiled once or twice with a coiling diameter of 30 mm–80 mm.

* * * * *